US008974176B2

(12) United States Patent
Sasaki et al.

(10) Patent No.: US 8,974,176 B2
(45) Date of Patent: Mar. 10, 2015

(54) COMPRESSOR AND METHOD OF ASSEMBLING THE SAME

(75) Inventors: Masashi Sasaki, Tokyo (JP); Takeshi Yoshimi, Tokyo (JP); Yasuyoshi Tozaki, Tokyo (JP); Akihiko Yano, Tokyo (JP); Atsushi Higashio, Tokyo (JP)

(73) Assignee: Mitsubishi Heavy Industries Compressor Corporation, Tokyo (JP)

( * ) Notice: Subject to any disclaimer, the term of this patent is extended or adjusted under 35 U.S.C. 154(b) by 528 days.

(21) Appl. No.: 13/429,859

(22) Filed: Mar. 26, 2012

(65) Prior Publication Data

US 2012/0243982 A1 Sep. 27, 2012

(51) Int. Cl.
*F04D 29/62* (2006.01)
*F04D 17/12* (2006.01)

(52) U.S. Cl.
CPC ..... *F04D 17/122* (2013.01); *F04D 29/624* (2013.01)
USPC ..... 415/199.2; 415/199.5

(58) Field of Classification Search
CPC ..... F01D 11/14; F05D 2230/64; F05D 2230/644; B23P 29/10; B23P 19/105; B23P 16/12; F04D 29/60; F04D 29/601; F04D 29/646; F04D 17/122
USPC ..... 415/199.2, 199.5, 173.1, 206, 220; 29/889.1, 889.2
See application file for complete search history.

(56) References Cited

U.S. PATENT DOCUMENTS 4,044,442 A * 8/1977 Carlson ..... 29/888.012
4,113,089 A * 9/1978 Bush et al. ..... 206/319
4,925,363 A 5/1990 Brown et al.
5,326,222 A 7/1994 Matyscak et al.
5,971,702 A 10/1999 Afton et al.
8,534,986 B2 * 9/2013 Borer et al. ..... 415/1
8,677,589 B2 * 3/2014 Ziekow et al. ..... 29/281.1

FOREIGN PATENT DOCUMENTS

EP 2 045 472 A1 4/2009
JP 4-41133 2/1992
JP 10-220399 8/1998
JP 2000-38988 2/2000
JP 3049059 3/2000
JP 2011-220307 11/2011

OTHER PUBLICATIONS

Notification of Reason for Rejection issued Jan. 7, 2014 in corresponding Japanese Application No. 2010-093293 (with English translation).
Decision of Patent Grant issued Apr. 30, 2014 in corresponding Japanese Application No. 2010-093293 (with English translation).

* cited by examiner

*Primary Examiner* — Ninh H Nguyen
(74) *Attorney, Agent, or Firm* — Wenderoth, Lind & Ponack, L.L.P.

(57) ABSTRACT

Provided is a compressor that is capable of, with a simple configuration, facilitating the insertion operation of a compressor bundle by reliably preventing tilting thereof during insertion into a chamber; and that also makes it possible to reduce a roller size without increasing the contact pressure of rollers for sliding the compressor bundle. A small tilt sensor that detects a relative angle difference θ of the compressor bundle with respect to the bundle casing is provided at at least one location in the compressor bundle to be inserted into the chamber inside the bundle casing. In addition, the weight of the compressor bundle during the insertion into the chamber is supported by rollers provided at a bottom portion near the front end of the compressor bundle by making the rollers come in contact with an inner circumferential wall surface of the chamber.

9 Claims, 4 Drawing Sheets

COMPRESSOR AND METHOD OF ASSEMBLING THE SAME

CROSS-REFERENCE TO RELATED APPLICATIONS

This application is based on Japanese Patent Application No. 2010-093293, the contents of which are incorporated herein by reference.

TECHNICAL FIELD

The present invention relates to a compressor that is formed by accommodating a cylindrical compressor bundle, in which a rotor, rotor blades, and stator blades are included inside a bundle housing, in a cylindrical chamber formed inside a bundle casing and to a method of assembling the same.

BACKGROUND ART

In this type of compressor, with conventional units having compressor bundles whose weight is in up to about 20-ton class, the compressor bundle is inserted into a chamber by sliding it thereinto from an opening provided at one end of the chamber. However, with a recent increase in the size of compression equipment, there are now 100-ton class compressor bundles, and it is very difficult to accommodate such a heavy compressor bundle in a chamber by sliding it thereinto. Because of this, as disclosed in the Publication of Japanese Patent No. 3049059, rollers are provided in the bundle casing (chamber), and the compressor bundle is placed on the rollers so that it can be inserted smoothly.

A clearance between an outer circumferential portion of the compressor bundle and an inner circumferential wall surface of the chamber is set to be very small in order to prevent leakage of compression fluid, and even for a large compressor bundle whose outer diameter exceeds 2 m, the clearance described above is not even 1 mm. Because of this, if the compressor bundle tilts toward the chamber even slightly during insertion into the chamber, the outer circumferential portion of the compressor bundle interferes with the inner circumferential wall surface of the chamber, which causes damage, dents, etc., which would deteriorate the airtightness, thus, deteriorating the quality of the compressor. Accordingly, in a technique disclosed in the Publication of Japanese Patent No. 3049059, the rollers provided in the chamber are made height adjustable by means of screw jacks, and, when the compressor bundle tilts, the heights of rollers are adjusted with the screw jack to correct the tilting.

SUMMARY OF INVENTION

Technical Problem

However, even if such height-adjustable rollers are provided, it is difficult to reliably and proactively prevent interference between the compressor bundle and the chamber because, when actually inserting the compressor bundle into the chamber, it is necessary for an operator to adjust the roller height while intuitively ascertaining the degree of tilting of the compressor bundle, which requires the operator to have highly developed skills and is highly time consuming, and also because, in some cases, the tilting of the compressor bundle is corrected by adjusting the roller height after the compressor bundle has interfered with the inner circumferential wall surface of the chamber.

Because the clearance between the compressor bundle and the inner circumferential wall of the chamber is small, as described above, in the case in which the rollers are interposed in this space, the rollers are provided on the inner circumferential wall surface of the chamber or on the compressor bundle by being embedded therein. Accordingly, it is desirable that the outer diameters of the rollers be small. However, the rollers are generally formed of steel, and if the outer diameters of these steel rollers are made small, the contact pressure against a traveling surface of the rollers is increased in combination with the heavy weight of the compressor bundle, and thus, the rollers may be worn and damaged or indentations, damage, etc. may occur on the traveling surface.

If the rollers are continuously subjected to the weight of the compressor bundle during the operation of the compressor, fretting wear occurs at roller bearings due to vibrations from the operation, which may shorten the lifetime of the roller bearings; therefore, as disclosed in the Publication of Japanese Patent No. 3049059, the rollers are made height-adjustable by means of the screw jacks, and the roller heights are lowered after inserting the compressor bundle so that the weight of the compressor bundle is not exerted on the rollers. However, making the rollers height-adjustable in this way tends to complicate the structure thereof.

The present invention has been conceived in order to solve the above-described problems, and an object thereof is to provide a compressor that is capable of, with a simple configuration, facilitating the insertion operation of a compressor bundle by reliably preventing tilting thereof during insertion into a chamber; and that also makes it possible to reduce the roller size without increasing the contact pressure of rollers for sliding the compressor bundle, thereby, taken together, making it possible to increase the durability of rollers, and to provide a method of assembling the same.

Solution to Problem

The present invention employs the following solutions in order to achieve the above-described object.

Specifically, a compressor according to a first aspect of the present invention is a compressor configured such that a compressor bundle, in which a rotor, rotor blades, and stator blades are included inside a substantially cylindrical bundle housing, is inserted, from the rear to front in an axial direction, into a horizontally extending, substantially cylindrical chamber formed inside the bundle casing, and outer diameter fitting portions provided at the front end and rear end of the compressor bundle tightly fit with inner diameter fitting portions provided at the front end and rear end of the bundle casing, thus positioning the compressor bundle, the compressor including relative angle difference detecting means, provided at at least one location in the compressor bundle, for detecting a relative angle difference of the compressor bundle with respect to the bundle casing.

With this configuration, when inserting the compressor bundle into the chamber of the bundle casing, insertion can be performed while detecting the relative angle difference of the compressor bundle with respect to the bundle casing with the relative angle difference detecting means. Accordingly, the tilting can be corrected before the compressor bundle becomes excessively tilted to cause interference with the inner circumferential wall surface of the chamber, and the insertion can be performed smoothly by preventing interference with the chamber. In this way, the compressor bundle can be easily inserted into the chamber with a simple configuration, without requiring highly developed skills.

With a compressor according to a second aspect of the present invention, in the first aspect, the weight of the compressor bundle during the insertion into the chamber is supported by a roller provided at a bottom portion near the front end of the compressor bundle by making the roller come in contact with an inner circumferential wall surface of the chamber; and the relative angle difference detecting means is provided near the rear end of the compressor bundle.

With the above-described configuration, the compressor bundle can be inserted into the chamber while supporting the portion near the front end of the compressor bundle with the roller and correcting the tilting of the compressor bundle by means of the relative angle difference detecting means provided near the rear end thereof. Because it suffices to provide the relative angle difference detecting means only at one location, it is possible to prevent tilting of the compressor bundle with a simple structure, facilitating the insertion operation.

With a compressor according to a third aspect of the present invention, in the first or the second aspect, a depression which is radially further outward than the inner circumferential wall surface is formed near the front end of the chamber; and a relative positional relationship between the roller and the depression is set such that, in a state in which the compressor bundle is completely accommodated and positioned in the chamber, the roller is positioned over the area of the depression, thus breaking the contact between the roller and the bundle casing.

With the above-described configuration, the roller is positioned over the area of the depression in a state in which the compressor bundle is completely accommodated and positioned in the chamber, thus separating from the inner circumferential wall surface of the chamber. Accordingly, the weight of the compressor bundle is not exerted on the roller during the operation of the compressor, and thus, fretting wear of the roller bearing can be prevented with a simple structure, and the durability of the roller can be enhanced.

With a compressor according to a fourth aspect of the present invention, in the second or the third aspect, at least an outer circumferential portion of the roller is formed of a copper-based material.

With the above-described configuration, because at least the outer circumferential portion of the roller, that is, the portion that comes in contact with the inner circumferential wall surface of the chamber, is formed of a copper-based material whose Young's modulus is lower than steel, in the case in which the outer diameter is the same as a conventional steel roller, the contact pressure against the inner circumferential wall surface of the chamber becomes lower. Accordingly, the outer diameter of the roller can be made small without increasing the contact pressure.

With a compressor according to a fifth aspect of the present invention, in the fourth aspect, peening treatment is applied to at least the outer circumferential portion of the roller. With this configuration, compression stress is applied to the interior of the roller formed of the copper-based material whose strength is lower than steel, thus enhancing the strength and durability thereof, and the outer diameter can be reduced if the contact pressure is the same.

With a compressor according to a sixth aspect of the present invention, in the first or the second aspect, an adhesively mounted small tilt sensor is employed as the relative angle difference detecting means. By doing so, the relative angle difference detecting means can be provided very simply and at low cost, and the tilting of the compressor bundle can be reliably prevented. Moreover, because the small tilt sensor can be left adhered to the compressor bundle, there is no trouble involved in remounting.

When inserting the compressor bundle of the compressor according to any one of the first to sixth aspects into the chamber of the bundle casing, a method of assembling a compressor according to the present invention includes inserting the front end of the compressor bundle into the chamber; detecting a relative angle difference of the compressor bundle with respect to the bundle casing with the relative angle difference detecting means; and inserting the compressor bundle into the chamber while correcting a tilt angle thereof so that the relative angle difference falls within an angular range that makes it possible to insert the compressor bundle into the chamber without interfering with an inner circumferential wall surface of the chamber.

With the present invention, when inserting the compressor bundle into the bundle casing (chamber), insertion can be performed while detecting the relative angle difference of the compressor bundle with respect to the bundle casing with the relative angle difference detecting means, and the insertion can be performed easily while preemptively preventing interference between the compressor bundle and the bundle casing without requiring highly developed skills.

Advantageous Effects of Invention

In this way, with a compressor according to the present invention and a method of assembling the same, it is possible, with a simple configuration, to facilitate the insertion operation of a compressor bundle by reliably preventing tilting thereof during insertion into a chamber and it is also made possible to reduce the roller size without increasing the contact pressure of rollers for sliding the compressor bundle, thereby, taken together, making it possible to increase the durability of the rollers.

DESCRIPTION OF EMBODIMENT

An embodiment of the present invention will be described below with reference to FIGS. 1 to 4.

Figure 1:
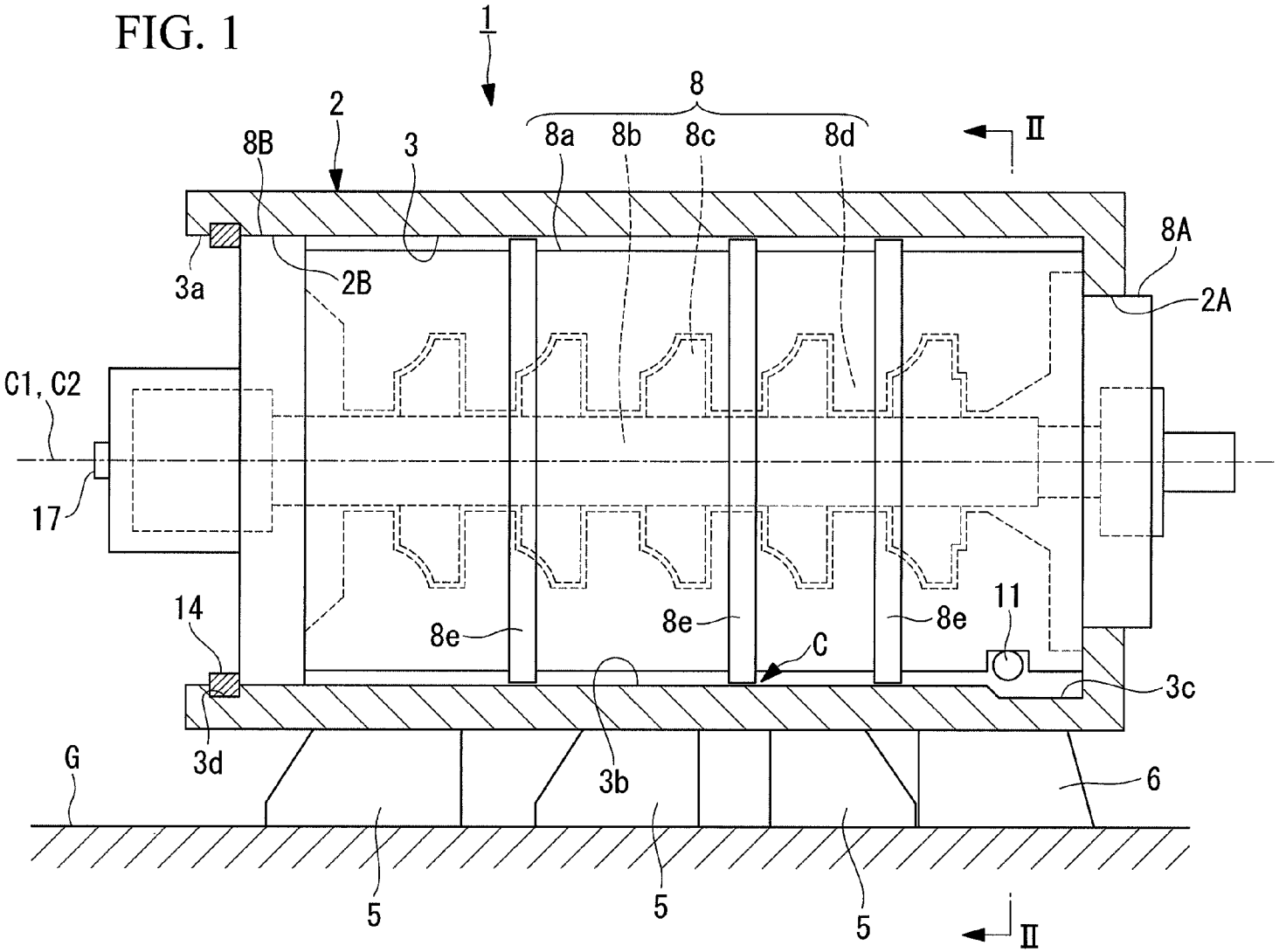
FIG. 1 is a longitudinal cross-sectional view showing, in outline, the configuration of a compressor according to an embodiment of the present invention.
Figure 2:
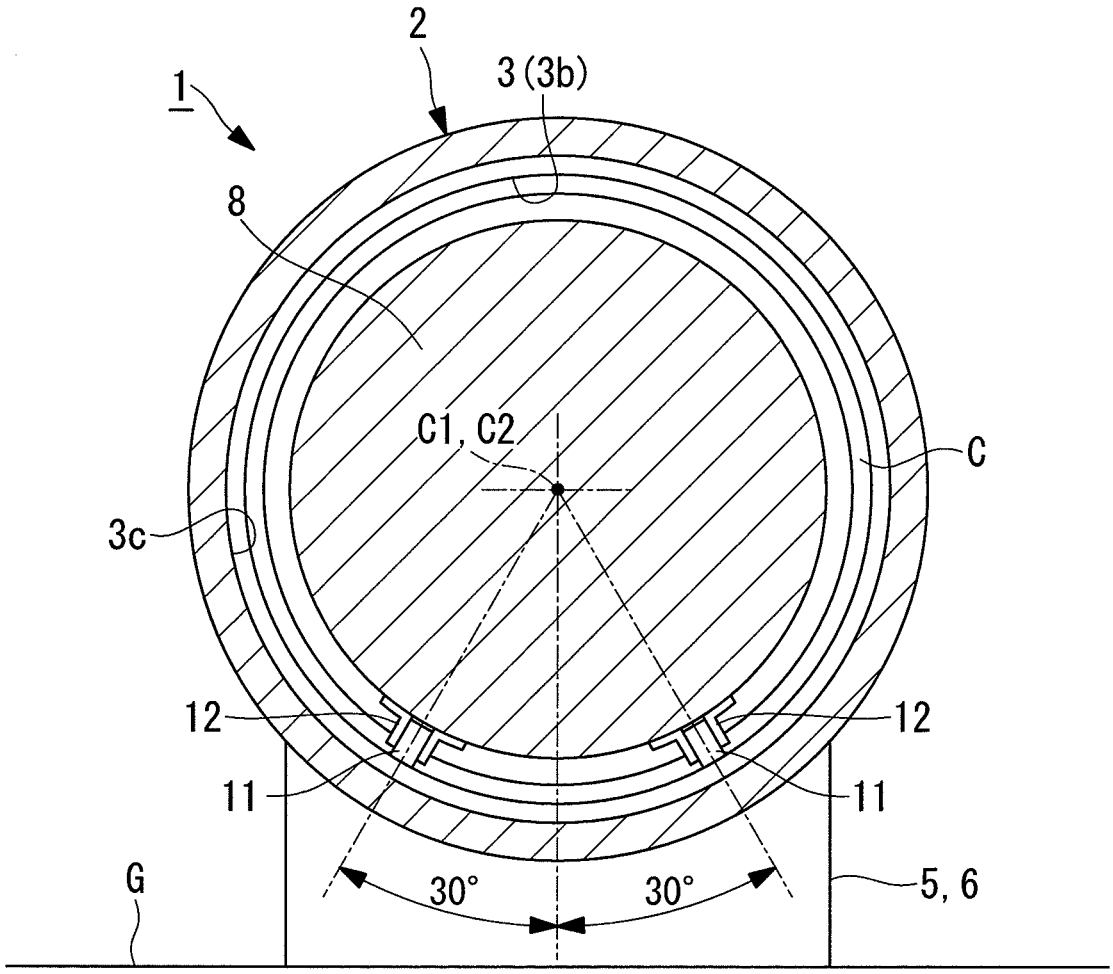
FIG. 2 is a longitudinal cross-sectional view of the compressor taken along the line II-II in FIG. 1.

As shown in FIGS. 1 and 2, a compressor 1 according to the embodiment of the present invention is provided with a substantially cylindrical bundle casing 2, and a substantially cylindrical chamber 3 is formed thereinside. The rear end (the left side when viewing FIG. 1) of the chamber 3 opens widely as a bundle insertion opening 3*a*. By means of a plurality of intake nozzles 5, a single discharge nozzle 6, support leg members (not shown), etc., this bundle casing 2 is set so as to be at a predetermined height with respect to an installation surface G and also so that a center axis C1 of the chamber 3 becomes horizontal.

A compressor bundle 8 is inserted into the chamber 3 of the bundle casing 2 from the bundle insertion opening 3*a*, that is, from rear to front in the axial direction. This compressor bundle 8 has a known basic configuration in which a rotor 8*b*, which is a main shaft, rotor blades 8*c*, and stator blades 8*d* are included inside a substantially cylindrical bundle housing 8*a*, and step-shaped outer-diameter fitting portions 8A and 8B provided at the front end and the rear end individually fit tightly with inner circumferential portions of inner-diameter fitting portions 2A and 2B provided at the front end and the rear end of the bundle casing 2, respectively; by doing so, a center axis C2 of the compressor bundle 8 is positioned so as to align with the center axis C1 of the chamber 3.

Several air-sealing ribs 8*e* are formed in the area surrounding the bundle housing 8*a* of the compressor bundle 8, and fine clearances C are set between these air-sealing ribs 8*e* and an inner circumferential wall surface 3*b* of the chamber 3. The sizes of these clearances C are not even 1 mm, even when, for example, the total length of the compressor bundle 8 exceeds 4 m and the outer diameter thereof exceeds 2 m.

A pair of left and right rollers 11 is provided via brackets 12 at bottom portions near the front end of the compressor bundle 8. As shown in FIG. 2, these rollers 11 are installed at positions separated by, for example, 30 degrees each to the left and right of a vertical line. These rollers 11 support the weight of the compressor bundle 8 while rolling in contact with the inner circumferential wall surface 3*b* of the chamber 3 during the insertion of the compressor bundle 8 into the chamber 3.

As shown in FIG. 1, a groove-like depression 3*c* in the form of a ring, which is depressed radially further outward than the inner circumferential wall surface 3*b*, is formed near the front end of the chamber 3. Then, in a state shown in FIG. 1 in which the compressor bundle 8 is completely accommodated and positioned in the chamber 3, the rollers 11 are positioned over the area of the depression 3*c*, and the relative positional relationship between the rollers 11 and the depression 3*c* is set so as to break the contact between the rollers 11 and the inner circumferential wall surface 3*b* of the chamber 3. Accordingly, in the state shown in FIG. 1, the rollers 11 are not in contact with the inner circumferential wall surface 3*b* of the chamber 3 but are suspended in the air.

At a position closer to the rear end of the inner circumferential wall surface 3*b* of the chamber 3, a fitting groove 3*d* is provided in the inner circumferential direction, and a locking ring 14 fits thereto. This locking ring 14 restricts rearward movement of the compressor bundle 8 at a position where the compressor bundle 8 is completely accommodated in the chamber 3 and also serves as a seal member that prevents leakage of compression fluid from between the inner circumferential wall surface 3*b* of the chamber 3 and an outer circumferential surface of the compressor bundle 8 (outside diameter fitting portion 8B).

In this compressor 1, the rotor 8*b* is rotationally driven at high speed by an electric motor (not shown) or the like; fluid to be compressed is supplied from the intake nozzles 5 into the compressor bundle 8 and is discharged from the discharge nozzle 6 after being compressed stepwise by the plurality of rotor blades 8*c* and stator blades 8*d*. In this way, for example, natural-gas liquefying compression, etc. is performed.

As shown in FIG. 1 and FIGS. 3A to 3C, an adhesively mounted small tilt sensor 17 is provided at the rear end of the compressor bundle 8. This small tilt sensor 17 serves as relative angle difference detecting means for detecting a relative angle difference of the compressor bundle 8 with respect to the bundle casing 2. Note that, without limitation to the small tilt sensor 17, a spirit level (for example, laser spirit level), a position sensor, or the like may be employed. Although the installation position for this relative angle difference detecting means is preferably the rear end of the compressor bundle 8, it may be provided at other sites.

Figure 3A:
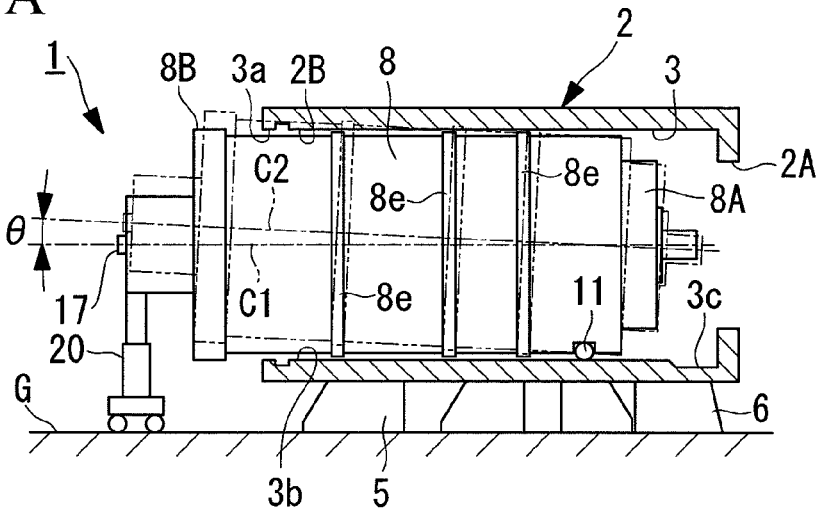
FIG. 3A is a longitudinal cross-sectional view showing a method of assembling the compressor according to the embodiment of the present invention.
Figure 3B:
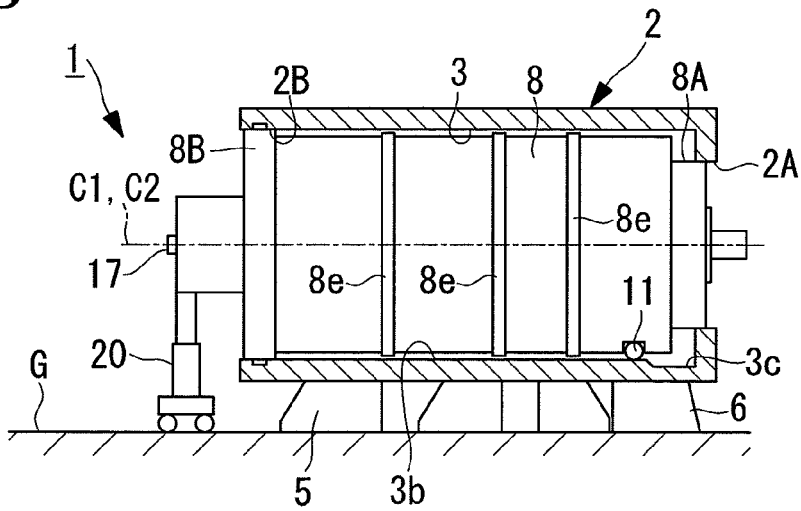
FIG. 3B is a longitudinal cross-sectional view showing the method of assembling the compressor according to the embodiment of the present invention.
Figure 3C:
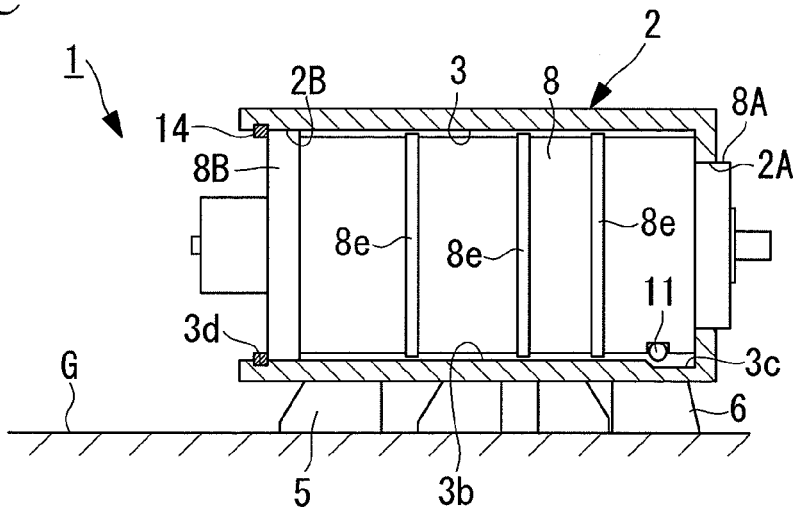
FIG. 3C is a longitudinal cross-sectional view showing the method of assembling the compressor according to the embodiment of the present invention.

As shown in FIGS. 3A to 3C, when inserting the compressor bundle 8 into the chamber 3, the insertion is performed while supporting the rear end of the compressor bundle 8 with a height-adjustable carriage 20. Until the rollers 11 come in contact with the inner circumferential wall surface 3*b* of the chamber 3 when the front end (portion immediately after the outer diameter fitting portion 8A) of the compressor bundle 8 is inserted into the chamber 3 from the bundle insertion opening 3*a*, an intermediate portion, etc. of the compressor bundle 8 are supported by a height-adjustable support base (not shown) or a crane or the like, and it is inserted into the chamber 3 while adjusting the height thereof at the front end.

As shown in FIG. 3A, in the process of inserting the compressor bundle 8 into the chamber 3, a relative angle difference θ of the compressor bundle 8 with respect to the bundle casing 2 is detected by the small tilt sensor 17, and an assembly method is employed in which the compressor bundle 8 is inserted into the chamber 3 while correcting the tilt angle thereof as needed so that this relative angle difference θ falls within an angular range in which the compressor bundle 8 can be inserted into the chamber 3 without causing interference with the inner circumferential wall surface 3*b* of the chamber 3. A jack (not shown) or the like is employed for propelling the compressor bundle 8 in the axial direction. Because the weight of the compressor bundle 8 at the front end thereof is supported by the rollers 11, it is possible to smoothly insert the compressor bundle 8 into the chamber 3.

Then, as shown in FIG. 3B, when the outside diameter fitting portion 8A at the front end of the compressor bundle 8 fits with the inner diameter fitting portion 2A at the front end of the bundle casing 2 and the outer diameter fitting portion 8B at the rear portion of the compressor bundle 8 fits with the inner diameter fitting portion 2B at the rear end of the bundle casing 2, the small tilt sensor 17 can stop detecting the relative angle difference θ.

Furthermore, as shown in FIG. 3C, once the compressor bundle 8 is completely accommodated in the chamber 3, the carriage 20 that supports the rear portion thereof is removed, and the lock ring 14 is mounted, thus completing the assembly of the compressor 1 allowing it to be operated. During the operation of the compressor 1, as described above, the rollers 11 are positioned in the area of the depression 3*c* and are separated from the inner circumferential wall surface 3*b* of the chamber 3.

As has been described, with the configuration and assembly method of this embodiment, when inserting the compressor bundle 8 into the chamber 3 of the bundle casing 2, the insertion can be performed while detecting the relative angle difference θ of the compressor bundle 8 with respect to the bundle casing 2 with the small tilt sensor 17. Accordingly, the tilting can be corrected before the compressor bundle 8 becomes excessively tilted and interferes with the inner circumferential wall surface 3*b* of the chamber 3, and the insertion can be performed smoothly by preventing interference with the chamber 3. Therefore, the compressor bundle 8 can be easily and safely inserted into the chamber 3 with a simple configuration, without requiring highly developed skills.

Note that, by employing the small tilt sensor 17 as the relative angle difference detecting means, the relative angle difference detecting means can be installed very simply and at low cost, and the tilting of the compressor bundle 8 can be reliably prevented. Moreover, because the small tilt sensor 17 can be left adhered to the compressor bundle 8, there is no trouble involved in remounting it every time the compressor bundle 8 is inserted into and taken out from the chamber 3.

Because the rollers 11 provided at the bottom portion near the front end of the compressor bundle 8 are placed in contact with the inner circumferential wall surface 3*b* of the chamber 3 to support the weight of the compressor bundle 8 during the insertion into the chamber 3, whereas the small tilt sensor 17 is provided near the rear end of the compressor bundle 8, the compressor bundle 8 can be inserted into the chamber 3 while supporting the portion near the front end of the compressor bundle 8 with the rollers 11 and correcting the tilting of the compressor bundle 8 by means of the small tilt sensor 17.

Because the portion near the rear end of the compressor bundle 8 where the small tilt sensor 17 is installed is furthest from the rollers 11, that is, the position where the displacement level is the largest when the compressor bundle 8 becomes tilted, by installing the small tilt sensor 17 at this position, the degree of tilting of the compressor bundle 8 can be accurately detected only with the single small tilt sensor 17. Therefore, the tilting of the compressor bundle 8 can be detected and corrected with a very simple structure, facilitating the insertion operation.

Because the depression 3*c* is formed near the front end of the chamber 3 and is configured such that the rollers 11 are positioned over the area of the depression 3*c* when the compressor bundle 8 is in the position where it is completely accommodated and positioned in the chamber 3 so as to break the contact between the rollers 11 and the bundle casing 2, the weight of the compressor bundle 8 is not exerted on the rollers 11 during the operation of the compressor 1, fretting wear at the bearings and contact portions of the rollers 11 can be prevented with a simple structure, and the durability of the rollers 11 can be enhanced.

The rollers 11 are formed of a copper-based material, for example, CAC304 (JISH5120) or the like, instead of conventional steel. The entire rollers 11 may be formed of such a copper-based material or only the outer circumferential portions that come in contact with the inner circumferential wall surface 3*b* of the chamber 3 may be formed of the copper-based material. Because the Young's modulus of a copper-based material is about 10000 kgf/mm$^2$, which is considerably lower than the Young's modulus of a steel (about 21000 kgf/mm$^2$), in the case in which the outer diameters are the same as those of conventional steel rollers, the contact pressure against the inner circumferential wall surface 3*b* of the chamber 3 becomes lower. Accordingly, the outer diameters of the rollers 11 can be made small without increasing the contact pressure, thereby enhancing the ease of layout related to the installation of the rollers 11, thus facilitating the installation thereof.

The contact pressure of the rollers 11 against the inner circumferential wall surface 3*b* of the chamber 3 can be obtained from the following expression.

$$\text{Contact pressure } p_{max}\ (\text{N/mm}^2)=(PE/\pi LR)^{0.5}$$

In the above expression, P is vertical load, that is the weight (N) of the front end of the compressor bundle 8, E is the Young's modulus (N/mm$^2$), L is the width (mm) of the rollers 11, and R is the radius (mm) of the rollers 11. If E, which is the Young's modulus included in the numerator of the above expression, decreases, the contact pressure $p_{max}$ also decreases.

Peening treatment is applied to at least the outer circumferential portions of the rollers 11, that is, the portions that come in contact with the inner circumferential wall surface 3*b* of the chamber 3, thereby applying compression stress thereto, enhancing the strength thereof. Examples of this peening treatment include, for example, shot peening in which shot (fine iron particles) is made to collide with an object to be treated with a force of compressed air; cavitation shotless peening in which, without using shot, the object to be treated is subjected to a high-pressure liquid jet in air or liquid, thereby generating a cavitation jet flow, and shock waves generated when cavitation bubbles collapse or impact forces of microjets are employed; and so on.

Figure 4:
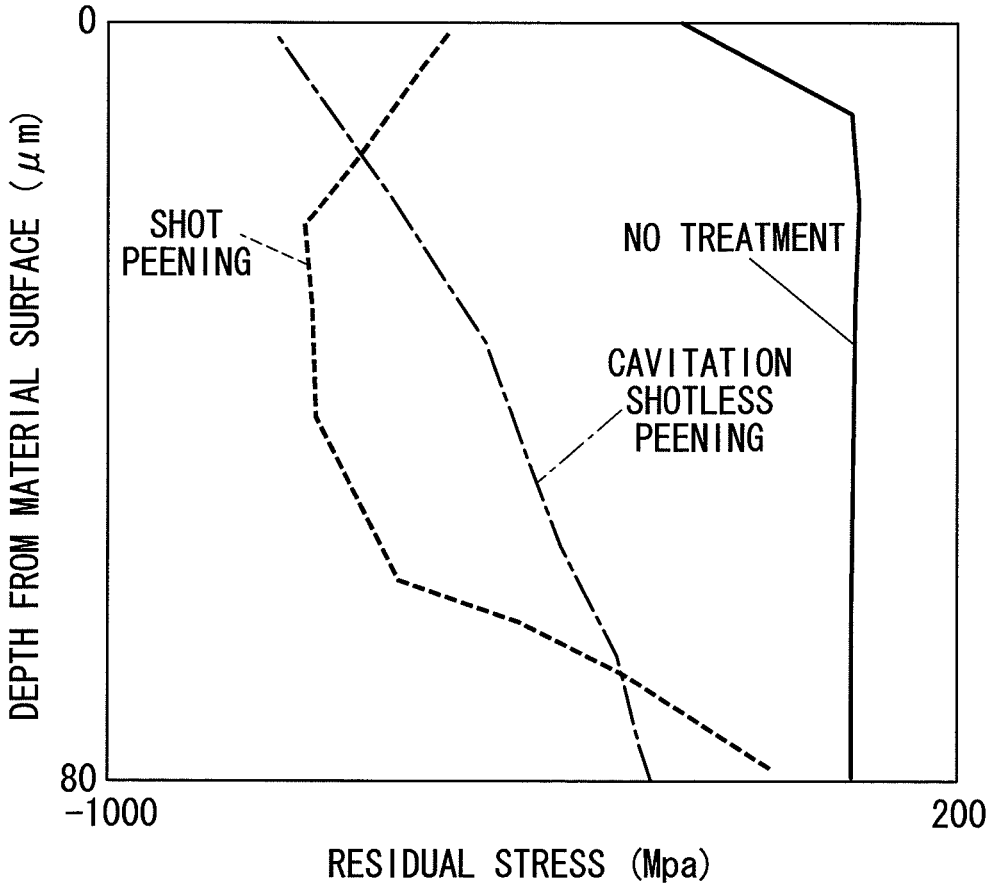
FIG. 4 is a line diagram showing the relationship between the depth from a material surface and residual stress in peening treatment on copper-based materials.

FIG. 4 is a graph that shows the relationship between the depth from a material surface and residual stress for the case in which shot peening is applied to a copper-based material, the case in which cavitation shotless peening is applied, and the case in which such peening treatment is not applied. Compared with the case in which the peening treatment is not applied, the residual stress clearly increases up to a predetermined depth from the material surface in the cases in which the shot peening and the cavitation shotless peening are applied, which indicates that the surfaces are strengthened.

Comparing the shot peening and the cavitation shotless peening, the shot peening tends to apply greater residual stress in the interior rather than near the surface of the material, whereas the cavitation shotless peening tends to apply greater residual stress near the surface of the material. Accordingly, it is desirable to apply the cavitation shotless peening after applying the shot peening, thus applying residual stress both in the interior and at the surface of the material to strengthen the material.

In this way, by applying the peening treatment to at least the outer circumferential portions of the rollers 11 formed of a copper-based material, compression stress is applied to the interior of the rollers 11 formed of the copper-based material, whose strength is lower than a steel, thus enhancing the strength and durability thereof, and thereby, the outer diameters can be reduced if the contact pressure is the same and the factor of safety can be increased if the outer diameters are the same. Of course, the peening treatment may be applied to other surfaces without limitation to the outer circumferential portions of the rollers 11.

If numerous fine dimples are formed at the outer circumferential surface of the rollers 11, because lubricant is held in the dimples and lubrication is enhanced, it is possible to increase the wear resistance of the rollers 11 and also to insert the compressor bundle 8 into the chamber 3 more smoothly. With regard to the formation of the dimples, they may be formed by causing the shot to collide with the outer circumferential surface of the rollers 11 when applying the shot peening described above, or they may be formed when applying the cavitation shotless peening by setting the treatment so as to create cavities (eroded depressions).

The present invention is, of course, not limited only to the forms of the embodiment described above, and it is conceivable to include alterations that do not deviate from the scope of the claims. For example, the shape and structure of the bundle casing 2 and the compressor bundle 8, the number of rollers 11 and the positions thereof, and so on may be altered. In short, the present invention is applicable so long as a bundle-type compressor has a configuration in which a compressor bundle is inserted into a chamber formed inside a cylindrically formed bundle casing with a small clearance.

The invention claimed is:

1. A compressor configured such that a compressor bundle, in which a rotor, rotor blades, and stator blades are included inside a substantially cylindrical bundle housing, is inserted, from the rear to front in an axial direction, into a horizontally extending, substantially cylindrical chamber formed inside the bundle casing, and outer diameter fitting portions provided at the front end and rear end of the compressor bundle tightly fit with inner diameter fitting portions provided at the front end and rear end of the bundle casing, thus positioning the compressor bundle, the compressor comprising relative angle difference detecting means, provided at at least one location in the compressor bundle, for detecting a relative angle difference of the compressor bundle with respect to the bundle casing.

2. A compressor according to claim 1, wherein the weight of the compressor bundle during the insertion into the chamber is supported by a roller provided at a bottom portion near the front end of the compressor bundle by making the roller come in contact with an inner circumferential wall surface of the chamber; and the relative angle difference detecting means is provided near the rear end of the compressor bundle.

3. A compressor according to claim 1, wherein a depression which is radially further outward than the inner circumferential wall surface is formed near the front end of the chamber; and a relative positional relationship between the roller and the depression is set such that, in a state in which the compressor bundle is completely accommodated and positioned in the chamber, the roller is positioned over the area of the depression, thus breaking the contact between the roller and the bundle casing.

4. A compressor according to claim 2, wherein at least an outer circumferential portion of the roller is formed of a copper-based material.

5. A compressor according to claim 4, wherein peening treatment is applied to at least the outer circumferential portion of the roller.

6. A compressor according to claim 1, wherein an adhesively mounted small tilt sensor is employed as the relative angle difference detecting means.

7. A compressor according to claim 3, wherein at least the outer circumferential portion of the roller is formed of a copper-based material.

8. A compressor according to claim 7, wherein peening treatment is applied to at least the outer circumferential portion of the roller.

9. A method of assembling a compressor, wherein, when inserting the compressor bundle of the compressor according to claim 1 into the chamber of the bundle casing, the method comprises:

inserting the front end of the compressor bundle into the chamber;

detecting a relative angle difference of the compressor bundle with respect to the bundle casing with the relative angle difference detecting means; and inserting the compressor bundle into the chamber while correcting a tilt angle thereof so that the relative angle difference falls within an angular range that makes it possible to insert the compressor bundle into the chamber without interfering with an inner circumferential wall surface of the chamber.

* * * * *